United States Patent [19]

Leibee et al.

[11] Patent Number: 4,711,312

[45] Date of Patent: Dec. 8, 1987

[54] DRILL BIT

[75] Inventors: Donald L. Leibee; Owen K. Crist, both of Bedford, Pa.

[73] Assignee: The Marmon Group, Inc., Chicago, Ill.

[21] Appl. No.: 888,302

[22] Filed: Jul. 22, 1986

[51] Int. Cl.[4] ..... E21B 10/60

[52] U.S. Cl. ..... 175/393; 175/410; 175/418

[58] Field of Search ..... 175/417, 418, 410, 393, 175/422 R

[56] References Cited

U.S. PATENT DOCUMENTS

| | | | |
|---|---|---|---|
| 4,330,044 | 5/1982 | Orr et al. | 175/410 |
| 4,356,873 | 11/1982 | Dziak | 175/410 |
| 4,603,751 | 8/1986 | Erickson | 175/410 |
| 4,605,079 | 8/1986 | Leibee et al. | 175/410 |

*Primary Examiner*—Stephen J. Novosad

*Attorney, Agent, or Firm*—Kline, Rommel & Colbert

[57] ABSTRACT

A drill bit for use in combination with a through-the-steel drill stem, the drill bit including an elongated body portion having a bore through which cuttings may be removed, a web extending transversely across the bore for receiving a drill tip, and drill ports leading from the drill tip to the bore and from the periphery of the body portion to the bore, the drill ports comprising opposed axially extending openings contoured as a hemisphere to define opposed axially extending faces of the web and opening to the bore from the drill tip and extending axially along the body portion and opening from the periphery thereof to the bore below the web. The drill bit may be provided with a sleeve to delimit the drill ports.

5 Claims, 6 Drawing Figures

DRILL BIT

BRIEF BACKGROUND, FIELD AND OBJECTIVES OF THE INVENTION

This invention relates to improvement in drill bits for through-the-steel drill stems of which the drill bit of our co-pending application Ser. No. 746,804, now U.S. Pat. No. 4,605,079, is a precursor. The invention was primarily developed in connection with mine roof drilling and it is thus described herein. However, it will be readily appreciated that our improved drill bit may be used with equal facility for other drilling operations, and description of the same in relation to mine roof drilling is not to be construed as a limitation on the scope of the invention.

In mining operations, such as coal mining, it has become a widely accepted practice to support the mine roof by means of roof bolts as embedded within spaced apart holes drilled in the mine roof. Roof bolts serve to pin pieces of loose material to solid rock above, reinforce areas of the underground arch, prevent sheet movement of rock strata, and form a solid self-supporting beam of several weak strata. With each advance of the mine face additional roof bolts are required and it thus follows that there will be an extremely large number of holes drilled into the mine roof for receiving roof bolts.

It is quite naturally desirable to prevent fine respirable dust from being suspended in the air the miners must breathe. As is obvious, drilling in a mine roof is a setting conducive to dispersion of drill dust within the mine. Through-the-steel drilling is thus usually used for drilling in mines. That is, use of a hollow drill stem in which a partial vacuum is created for drawing drill cuttings thereinto and thence to a collector. Drill bits for through-the-steel drill stems are provided with drill ports through which the drill cuttings may be drawn into the through-the-steel drill stem.

Others have previously proposed various types of drill bits for use with through-the-steel drill stems. By way of examples, as shown in U.S. Pat. Nos. 3,187,825; 3,434,553; 3,434,554; 3,613,807, 4,313,506; 4,330,044; and 4,492,278.

Drill bits of this type usually fall in the direction of those providing appropriate work surfaces, such as those of U.S. Pat. Nos. 4,313,506 and 4,492,278, or of those providing appropriate drill ports, such as that of U.S. Pat. No. 4,330,044.

As a subsequent improvement to the drill bit as shown in our co-pending application Ser. No. 746,804, now U.S. Pat. No. 4,605,079, we have found that a bit of this type having opposed hemispheric or radial cut drill ports opening to the bore from the drill tip and opening from the periphery of the bit and directly into the bore below the drill tip provides a bit having both an appropriate work surface and appropriate drill ports.

It is thus a primary object of this invention to provide a drill bit including a web for supporting a drill tip and in which the drill ports are contoured as a hemisphere with respect to opposed axially extending faces of the web, are open to the bore from the drill tip and extend axially along the bit and open from the periphery thereof to the bore below the web.

Our improved drill bit is preferably configured to receive a sleeve as designed to be indexed thereon with respect to the drill ports in a manner to delimit the same in somewhat the same manner as shown and described in our co-pending application Ser. No. 746,804.

Other objects and advantages of the invention will become apparent from the following detailed description, taken in connection with the accompanying drawings, and in which drawings:

DETAILED DESCRIPTION

Figure 1:
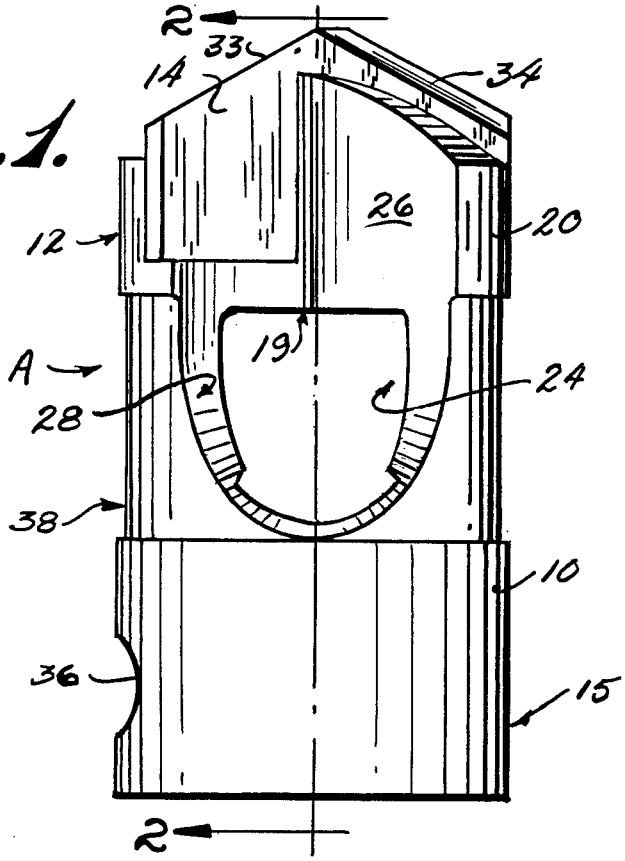
FIG. 1 is a side plan view of our improved drill bit.
Figure 2:
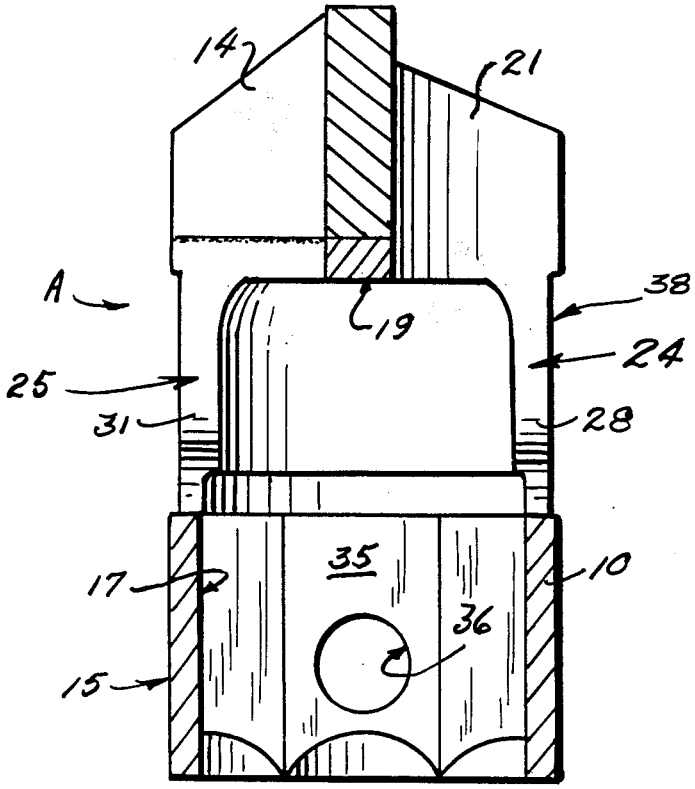
FIG. 2 is a transverse sectional view taken substantially on the line 2—2 of FIG. 1.
Figure 3:
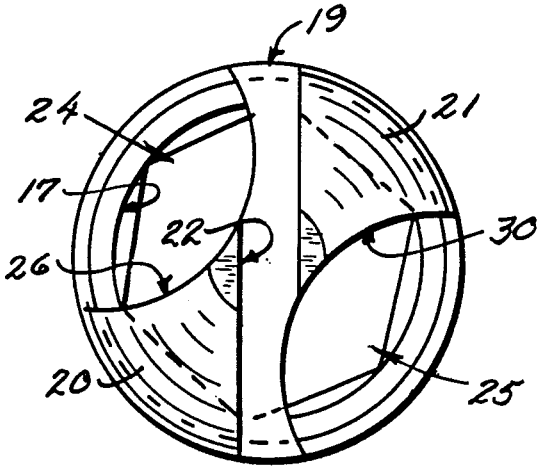
FIG. 3 is a top view of the bit of FIG. 1, but with the drill tip removed therefrom.
Figure 4:
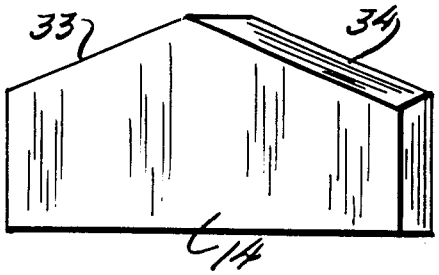
FIG. 4 is a side view of the drill tip.
Figure 5:
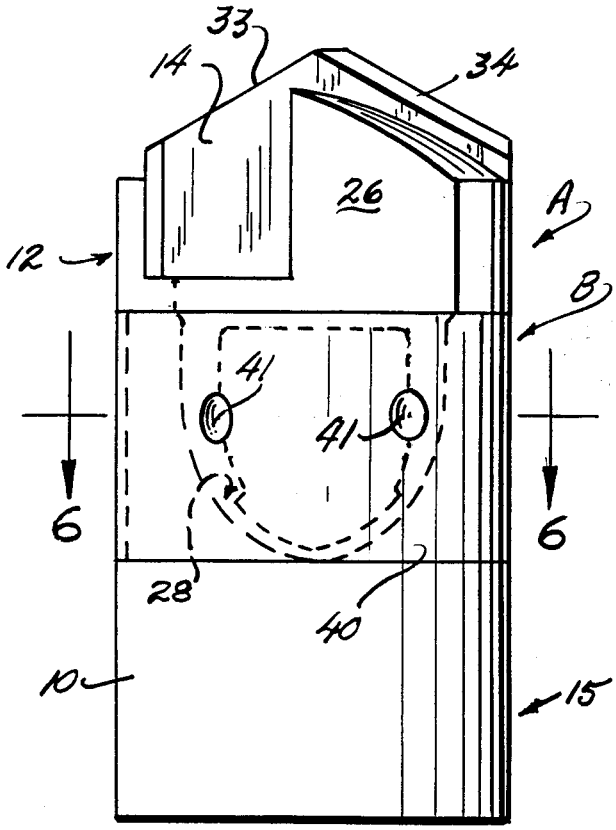
FIG. 5 is a side plan view of the drill bit of FIG. 1 having a sleeve mounted thereon for delimiting the drill cut receiving ports thereof.
Figure 6:
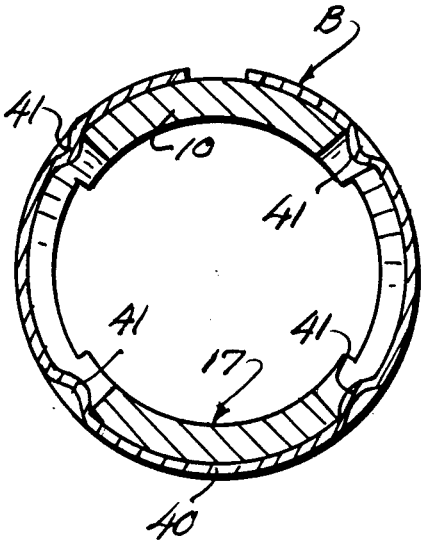
FIG. 6 is a transverse sectional view taken substantially along the line 6—6 of FIG. 5.

In the drawings, wherein similar reference characters designate corresponding parts throughout the several views, the letter A may generally designate our improved drill bit and the letter B a sleeve that may be received by drill bit A to delimit the drill ports thereof.

Drill bit A preferably comprises an elongated body portion 10 having a head portion 12, for receiving a drill tip 14 and a lower or shank portion 15 for mounting of the drill bit on a drill stem.

As shown, body portion 10 is preferably of a cylindrical configuration, having a bore 17 opening to the shank end thereof. As is apparent, body portion 10 may have other than a cylindrical periphery, polygonal for instance.

Head portion 12 includes a web 19 that extends across bore 17, from side-to-side of body portion 10, and is provided with upstanding opposed crown portions 20 and 21 which define therebetween a slot 22 within which drill tip 14 may be mounted and secured as by brazing.

Body portion 10 is provided with opposed axially extending drill ports 24 and 25. Drill ports 24 and 25 are preferably contoured as radial cuts, the upper reach of port 24 being preferably contoured to define hemispheric face 26 of web 19 and extending downwardly therefrom as a radial cut 28 having a uniform coincidence of contoured relation to face 26 and extending axially along body portion 10 and opening to bore 17 below web 19; and the upper reach of port 25 being preferably contoured to define hemispheric face 30 of web 19 and extending downwardly therefrom as a radial cut 31 having a uniform coincidence of contoured relation to face 30 and extending axially along body portion 10 and opening to bore 17 below web 19.

Face 26 of drill port 24 opens to cutting edge 33 of drill tip 14, and face 30 of drill port 25 opens to cutting edge 34 of drill tip 14.

As thus constructed, body portion 10 has drill ports 24 and 25 located on diametrically opposite sides thereof and which open directly to the bore from the drill tip and axially to the respective cutting edges of the drill tip.

It is obvious that the lower reaches of drill ports 24 and 25 could be squared off if desired.

At least the lower portion of bore 17 may be of such as a hexagonal configuration defining a socket 35 within which to receive the correspondingly hexagonal end of a through-the-steel drill stem (not shown). A female receptacle 36 may be provided through body portion 10 for receiving a mating male keeper of the drill stem (not shown) whereby to attach drill bit A to a drill stem.

Body portion 10 may be provided with a recess 38 which extends peripherally thereabout, for receiving sleeve B. The lower end of recess 38 is preferably disposed below the lower reaches of drill ports 24 and 25 and the upper end thereof extends across web 19 above the lowermost portions of contoured faces 26 and 30.

Sleeve means B preferably comprises a body portion 40, in the nature of a split sleeve having spaced apart nodules 41 thereabout. Nodules 41 are spaced apart in a manner to cooperatively interfit within drill ports 24 and 25 and thereby provide index means for positioning of sleeve B within recess 38.

Sleeve means B may be interfitted about body portion 10 in those situations in which it is desired to delimit drill ports 24 and 25 so that they basically open directly to and along the cutting edges of the drill tip and do not extend below the web thereof.

Various changes may be made to the forms of invention as herein shown and described without departing from the spirit of the invention or the scope of the following claims.

We claim:

1. A drill bit for use in combination with a through-the-steel drill stem, said drill bit including a drill tip and comprising a body portion having a head portion for receiving said drill tip, a lower portion, a bore through which cuttings may be removed to the drill stem, and drill ports comprising opposed axially extending openings contoured as a hemisphere with respect to said head portion and the periphery of said body portion and opening to said bore from said drill tip and extending axially along said body portion and opening from the periphery thereof to said bore below said head portion thereof.

2. A drill bit for use in combination with a through-the-steel drill stem, said drill bit including a drill tip; an elongated body portion having a lower portion for interconnection of the drill bit to a drill stem, a head portion, a bore through which cuttings may be removed to the drill stem, and drill ports leading from said drill tip to said bore and from the periphery of said body portion to said bore, said head portion including a web extending transversely across said bore for receiving said drill tip, said drill ports comprising opposed axially extending openings contoured as a hemisphere to define opposed axially extending faces of said web and opening to said bore from said drill tip and extending axially along said body portion and opening from the periphery thereof to said bore below said web.

3. A drill bit as specified in either of claims 1 or 2 and including sleeve means attached about said body portion intermediate the lower portion and head portion thereof and positioned thereabout to delimit said drill ports.

4. A drill bit as specified in claim 3 and wherein said sleeve means comprises a split-sleeve for removable attachment to said body portion and includes index means operative with said drill ports for positioning of said split-sleeve about said body portion.

5. A drill bit as specified in claim 3 and wherein said sleeve means comprises a split-sleeve for removable attachment to said body portion and includes a plurality of spaced apart nodules for interfitting within said drill ports for positioning of said split-sleeve about said body portion.

* * * * *

UNITED STATES PATENT AND TRADEMARK OFFICE

CERTIFICATE OF CORRECTION

PATENT NO. : 4,711,312

DATED : December 8, 1987

INVENTOR(S) : Donald L. Leibee, et al

It is certified that error appears in the above-identified patent and that said Letters Patent is hereby corrected as shown below:

The term of this patent subsequent to August 12, 2003 has been disclaimed.

Signed and Sealed this

First Day of March, 1988

*Attest:*

DONALD J. QUIGG

*Attesting Officer*

*Commissioner of Patents and Trademarks*